US006397647B1

(12) United States Patent
Kuo

(10) Patent No.: US 6,397,647 B1
(45) Date of Patent: Jun. 4, 2002

(54) PROTECTIVE COVER FOR A KEYHOLE OF A LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/798,973

(22) Filed: Mar. 6, 2001

(51) Int. Cl.[7] ..... E05B 13/02
(52) U.S. Cl. ..... 70/423; 70/455
(58) Field of Search ..... 70/423–428, 453–455

(56) References Cited

U.S. PATENT DOCUMENTS

| | | | | | |
|---|---|---|---|---|---|
| 316,574 | A | * | 4/1885 | Roland | 70/423 |
| 395,259 | A | * | 12/1888 | Barrett | 70/428 X |
| 594,447 | A | * | 11/1897 | Warner | 70/426 |
| 962,276 | A | * | 6/1910 | Voight | 70/423 X |
| 1,560,868 | A | * | 11/1925 | Shinn | 70/423 X |
| 1,757,387 | A | * | 5/1930 | Rabkin | 70/428 |
| 2,036,541 | A | * | 4/1936 | Ringseis | 70/454 X |
| 2,076,004 | A | * | 4/1937 | Ringseis | 70/454 |
| 2,188,532 | A | * | 1/1940 | Dominguez | 70/145 |
| 2,874,563 | A | * | 2/1959 | Schlage | 70/455 |
| 2,956,430 | A | * | 10/1960 | Simmons | 70/455 |
| 2,988,910 | A | * | 6/1961 | Eshbaugh et al. | 70/173 |
| 3,263,463 | A | * | 8/1966 | Duval et al. | 70/455 |
| 3,475,934 | A | * | 11/1969 | Reisner | 70/428 |
| 3,477,261 | A | * | 11/1969 | Siana | 70/427 |
| 3,723,682 | A | * | 3/1973 | Pecott | 70/425 X |
| 3,882,703 | A | * | 5/1975 | Hermann | 70/455 X |
| 4,104,898 | A | * | 8/1978 | Fois | 70/423 X |
| 5,934,121 | A | * | 8/1999 | Chen | 70/455 X |

* cited by examiner

*Primary Examiner*—Suzanne Dino Barrett
(74) *Attorney, Agent, or Firm*—Rosenberg, Klein & Lee

(57) ABSTRACT

A protective cover for a keyhole of a lock includes a cap and a pair of shutters. The cap has a crown and a skirt. The crown defines a central through-hole and a pair of radial slots at opposite sides of the central through-hole. The skirt is intended to be connected to the lock rotatably around the keyhole. The shutters each have a first end and a second end, with the first ends pivoted on the lock diametrically about the keyhole, and the second ends formed with respective stubs movable in the slots of the cap. Additionally, the shutters are configured to close the central through-hole of the crown when the cap is turned in a direction relative to the lock and to open the central through-hole of the crown when the cap is turned in an opposite direction relative to the lock.

14 Claims, 4 Drawing Sheets

PROTECTIVE COVER FOR A KEYHOLE OF A LOCK

BACKGROUND OF THE INVENTION

1. Field of the Invention

The present invention relates to a protective cover for a keyhole of a lock and, more particularly, to such a protective cover having a compact and simple structure.

2. Description of Related Art

Protective covers for keeping dust and moisture from entering keyholes are well known in the art. FIG. 5 illustrates such a protective cover including a cap (40) rotatably connected to a lock (50).

The cap (40) has a crown (43) formed with a central opening in alignment with a keyhole of the lock (50). Pivotally connected to the cap (40) at sides of the opening is a pair of doors (41) that normally close the opening under the action of respective torsion springs (42). As shown in FIG. 6, the doors (41) can be opened by a key prior to its insertion into the keyhole. Due to the springs (42), the doors (41) will close automatically at the exact moment when the key is removed from the lock (50).

This protective cover is satisfactory in keeping out dust and moisture which would otherwise impair working of the lock. However, the pivotal arrangement of the doors (41) necessitates a large space for their turning, which makes the cap (40) too bulky. Furthermore, the cover includes the torsion springs, each of which must be fabricated and assembled with the other parts, and so the total cost for the cover is relatively high.

Therefore, it is an objective of the invention to provide a protective cover for a keyhole of a lock to mitigate and/or obviate the aforementioned problems.

SUMMARY OF THE INVENTION

The object of the present invention is to provide a protective cover for a lock which is compact in structure.

Another object of the present invention is to provide a protective cover for a lock which is simple in structure.

Other objects, advantages and novel features of the invention will become more apparent from the following detailed description when taken in conjunction with the accompanying drawings.

DETAILED DESCRIPTION OF THE PREFERRED EMBODIMENT

Figure 1:
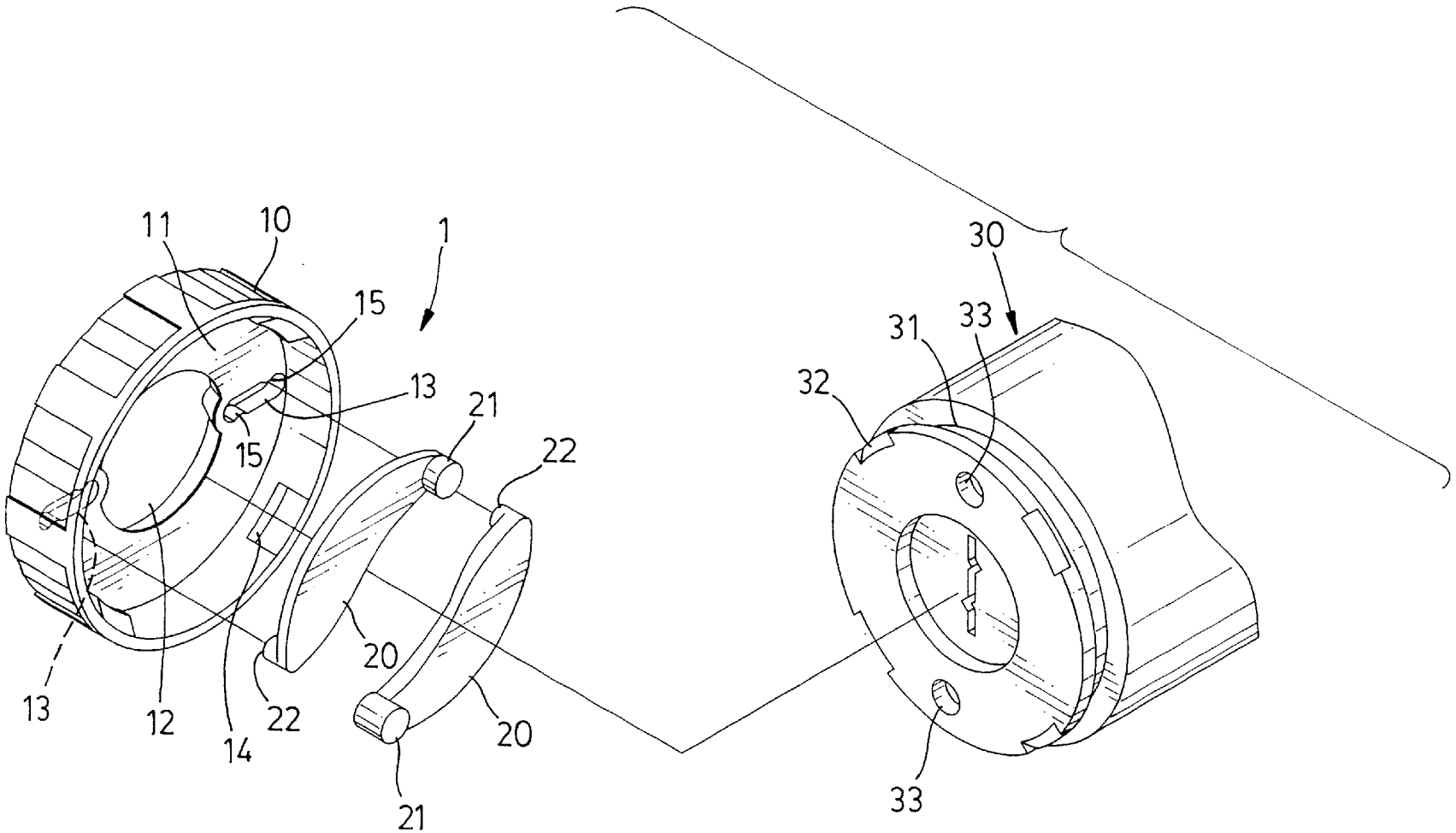
FIG. 1 an exploded perspective view of a preferred embodiment of a protective cover in accordance with the present invention for a keyhole of a lock.
Figure 2:
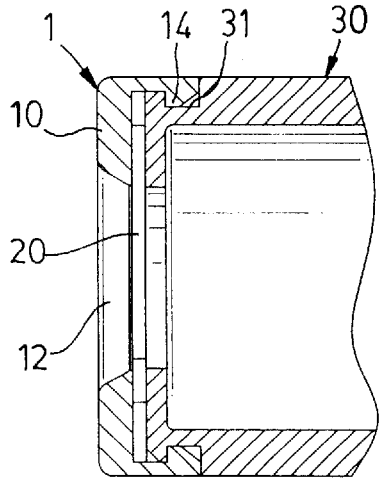
FIG. 2 is a fragmentary cross-sectional view of the protective cover shown in FIG. 1.

Referring to FIGS. 1 and 2, there is shown a preferred embodiment of a protective cover (1) in accordance with the present invention for shielding a keyhole of a lock (30). The cover (1) includes a cap (10) having a crown (11) and a skirt (not numbered), and a pair of shutters (20) disposed in the cap (10) between the crown (11) and the lock (30).

The crown (11) defines a central through-hole (12) to be aligned with the keyhole and a pair of radial slots (13) at opposite sides of the through-hole (12). The skirt is intended to be connected to the lock (30) in a way rotatable around the keyhole. For example, the skirt may have an inner periphery formed with a plurality of protrusions (14) adjacent to a distal end thereof, while the lock (30) may define therein an annular groove (31), either continuous or discontinuous, i.e. interrupted into two portions, to receive the protrusions (14) and enable them to be turned a predetermined amount relative to the lock (30), as best shown in FIG. 2.

It is also necessary for the lock (30) to define a plurality of notches (32) open to the annular groove (31) in order to allow the protrusions (14) of the cap (10) to enter the groove (31).

Figure 3:
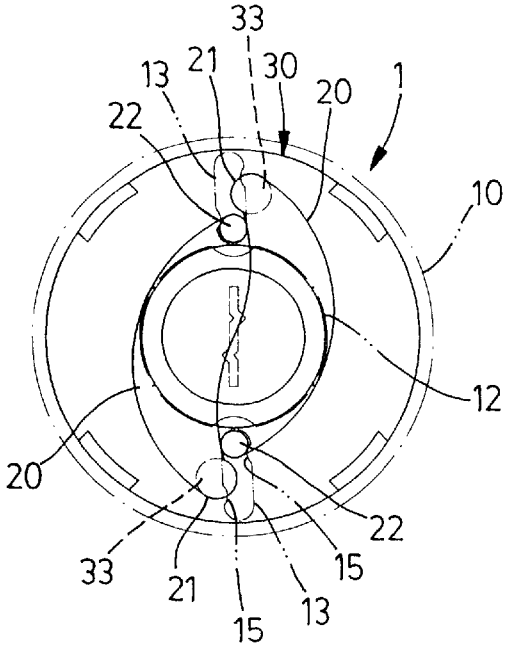
FIG. 3 is a side view showing the cover in a closed position.

Referring to FIGS. 1 and 3, the shutters (20) are configured to close the central throughhole hole (12) in the crown (11) of the cap (10), and are preferably of a symmetrically and complementarily curved shape as shown in FIG. 3.

The shutters (20) each have a first end and a second end, with the first ends formed with respective pintles (21) laterally extending towards the lock (30) and the second ends formed with respective stubs (22) laterally extending towards the crown (11) of the cap (10). In the illustrated embodiment, the lock (30) has a pair of diametrical bores (33) defined at sides of the keyhole to receive the pintles (21), thereby allowing the pintles (21) to pivot on the lock (30) diametrically about the key hole.

The stubs (22) of the shutters (20) are disposed in the radial slots (13) of the cap (10). Preferably, each of the radial slots (13) is formed with a pair of curved ends (15), for the purpose of stopping and holding a corresponding one of the stubs (22) after the cap (10) is fully turned in either direction.

Figure 4:
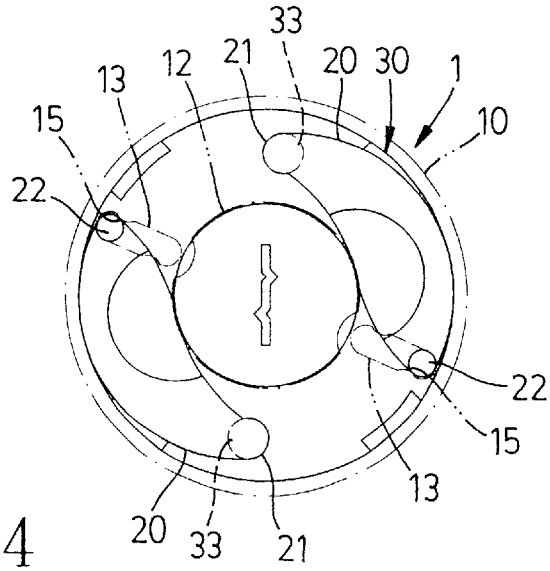
FIG. 4 is a side view showing the cover in an open position.
Figure 5:
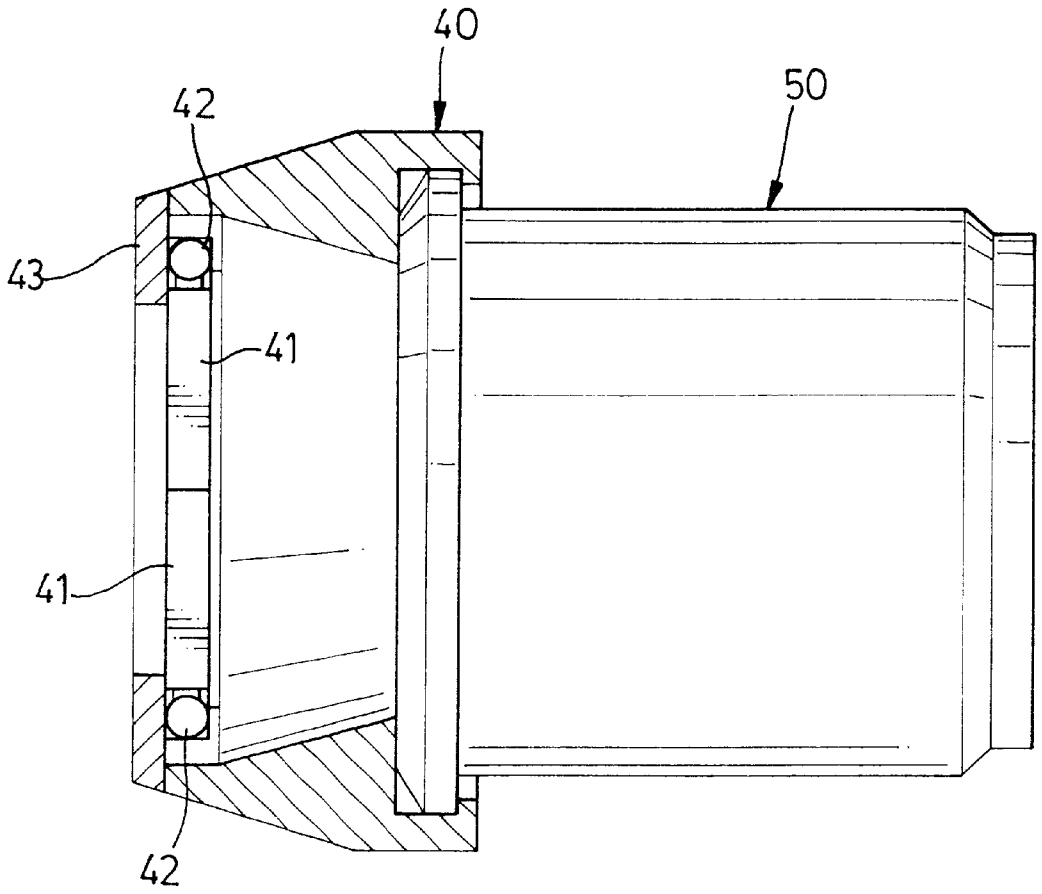
FIG.5 PRIOR ART
FIG. 5 is a cross-sectional view showing a conventional protective cover in a closed position.
Figure 6:
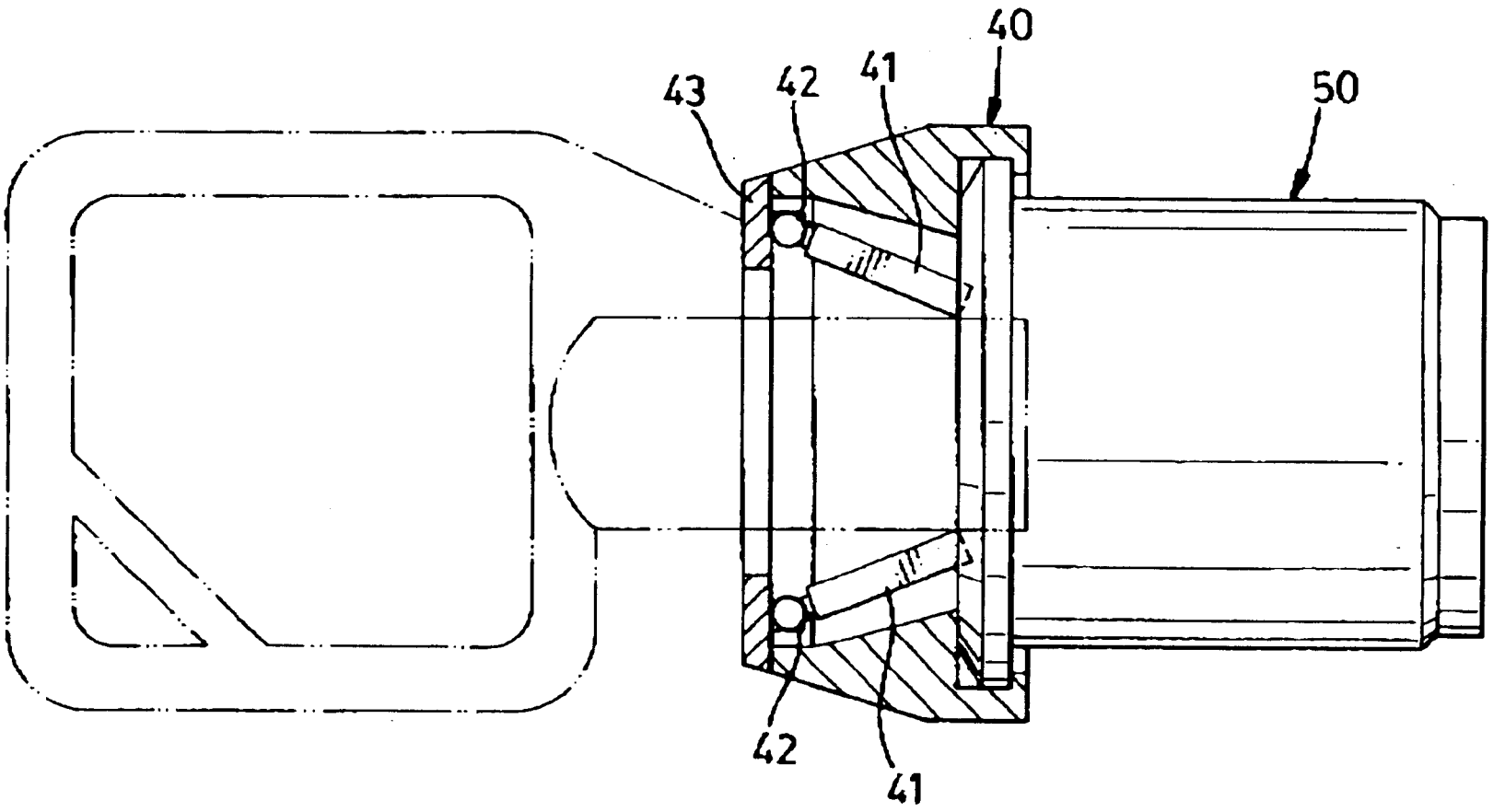
FIG. 6 is a cross-sectional view showing the conventional protective cover of FIG. 5 in an open position.

Referring to FIG. 4, the central through-hole (12) in the crown (11) can be opened merely by turning the cap (10) in a first direction relative to the lock (30). At this time, the stubs (22) are guided by the radial slots (13) of the cap (10) in such a way that the shutters (20) are pivoted away from each other about their pintles (21), until the stubs (22) are stopped and held in the associated curved ends (15) of the slots (13). As a result, the keyhole of the lock (13) is exposed.

The central through-hole (12) in the crown (11) can be closed by turning the cap (10) in a second direction opposite to the first direction. Now the shutters (20) are pivoted towards each other about their pintles (21), until the stubs (22) are stopped and held in the other associated curved ends (15) of the slots (13), when the shutters (20) are shut and the keyhole is shielded, as shown in FIG. 3.

From the above description, it is noted that the invention has the following advantages:

1. being compact in structure:

Because the shutters (20) are turned in the same plane they are disposed to be in, the inventive cover (1) is compact in structure.

2. being simple in structure:

Because there is no spring, the inventive cover (1) is simple in structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A protective cover (1) for a keyhole of a lock (30), comprising:

a cap (10) having a crown (11) and a skirt, said crown (11) defining a central through-hole hole (12) and a pair of radial slots (13) at opposite sides of a periphery defining said central through-hole (12), said skirt adapted to rotatably connect to said lock (30) around said keyhole;

a pair of shutters (20) each having a first end and a second end, said first ends being adapted to be pivoted on said lock (30) diametrically about said keyhole, said second ends being formed with respective stubs (22) movably received in said slots (13) of said cap (10); and wherein said shutters (20) are configured to close said central through-hole (12) of said crown (11) when said cap (10) is turned in a first direction relative to said lock (30) and to open said central through-hole (12) of said crown (11) when said cap (10) is turned in a second direction opposite to that of said first direction and relative to said lock (30).

2. The protective cover (1) as claimed in claim 1, wherein said skirt has an inner periphery formed with a plurality of protrusions (14) adjacent to a distal end thereof.

3. The protective cover (1) as claimed in claim 1, wherein said shutters (20) are configured to be curved symmetrically and complementarily to each other.

4. The protective cover (1) as claimed in claim 1, wherein each of said radial slots (13) is formed with a pair of curved ends (15) for stopping and holding a corresponding one of said stubs (22).

5. The protective cover (1) as claimed in claim 2, wherein said shutters (20) are configured to be curved symmetrically and complementarily to each other.

6. The protective cover (1) as claimed in claim 2, wherein each of said radial slots (13) is formed with a pair of curved ends (15) for stopping and holding a corresponding one of said stubs (22).

7. The protective cover (1) as claimed in claim 3, wherein each of said radial slots (13) is formed with a pair of curved ends (15) for stopping and holding a corresponding one of said stubs (22).

8. The protective cover as claimed in claim 1, wherein the shutter further has a pintle formed to correspond to the stub on the second end of the shutter and adapted to be pivotal in relation to the lock.

9. The protective cover as claimed in claim 2, wherein the shutter further has a pintle formed to correspond to the stub on the second end of the shutter and adapted to be pivotal in relation to the lock.

10. The protective cover as claimed in claim 3, wherein the shutter further has a pintle formed to correspond to the stub on the second end of the shutter and adapted to be pivotal in relation to the lock.

11. The protective cover as claimed in claim 4, wherein the shutter further has a pintle formed to correspond to the stub on the second end of the shutter and adapted to be pivotal in relation to the lock.

12. The protective cover as claimed in claim 5, wherein the shutter further has a pintle formed to correspond to the stub on the second end of the shutter and adapted to be pivotal in relation to the lock.

13. The protective cover as claimed in claim 6, wherein the shutter further has a pintle formed to correspond to the stub on the second end of the shutter and adapted to be pivotal in relation to the lock.

14. The protective cover as claimed in claim 7, wherein the shutter further has a pintle formed to correspond to the stub on the second end of the shutter and adapted to be pivotal in relation to the lock.

* * * * *